US008485687B2

(12) United States Patent
McQuistian et al.

(10) Patent No.: US 8,485,687 B2
(45) Date of Patent: Jul. 16, 2013

(54) LIGHT ASSEMBLY

(75) Inventors: Kevin McQuistian, Apollo, PA (US); Glenn Bauernfeind, Conway, PA (US)

(73) Assignee: Ansaldo STS USA, Inc., Pittsburgh, PA (US)

( * ) Notice: Subject to any disclaimer, the term of this patent is extended or adjusted under 35 U.S.C. 154(b) by 369 days.

(21) Appl. No.: 12/758,323

(22) Filed: Apr. 12, 2010

(65) Prior Publication Data

US 2011/0249434 A1 Oct. 13, 2011

(51) Int. Cl.
*F21V 7/00* (2006.01)

(52) U.S. Cl.
USPC ..... 362/247; 362/230; 362/249.02

(58) Field of Classification Search
USPC ..... 362/247, 230, 231, 240, 241, 245, 362/227, 249.02
See application file for complete search history.

(56) References Cited

U.S. PATENT DOCUMENTS 4,999,754 A 3/1991 Gary
5,580,156 A * 12/1996 Suzuki et al. ..... 362/184
6,367,950 B1 * 4/2002 Yamada et al. ..... 362/245
6,435,459 B1 8/2002 Sanderson et al.
6,509,840 B2 1/2003 Martineau
6,547,416 B2 4/2003 Pashley et al.
6,657,393 B2 12/2003 Natsume
6,773,139 B2 8/2004 Sommers
6,814,475 B2 11/2004 Amano
6,840,654 B2 1/2005 Guerrieri et al.
6,921,183 B2 7/2005 Yang et al.
6,953,264 B2 * 10/2005 Ter-Hovhannisian ..... 362/241
7,025,487 B2 * 4/2006 Holzmann et al. ..... 362/546
7,354,178 B2 4/2008 Han et al.
2003/0137838 A1 * 7/2003 Rizkin et al. ..... 362/240
2004/0095763 A1 * 5/2004 Guerrieri et al. ..... 362/240
2005/0157492 A1 7/2005 Chiu
2006/0012992 A1 1/2006 Lee
2006/0203484 A1 9/2006 Yu
2008/0068856 A1 3/2008 Schug et al.

* cited by examiner

*Primary Examiner* — Evan Dzierzynski
*Assistant Examiner* — Danielle Allen
(74) *Attorney, Agent, or Firm* — Eckert Seamans Cherin & Mellott, LLC; Stephen A. Bucchianeri

(57) ABSTRACT

A light assembly includes a lighting module having a number of LEDs and a reflector assembly disposed on the lighting module. The reflector assembly includes a number of individual reflector portions, each reflector portion being of generally concave shape and structured to selectively direct light emitted from a respective one of the number of LEDs. A lens member is disposed over the reflector assembly and a membrane is disposed between the reflector member and the lens.

17 Claims, 4 Drawing Sheets

LIGHT ASSEMBLY

BACKGROUND OF THE INVENTION

1. Field of the Invention

The present invention relates generally to lights and reflector assemblies. More particularly, the present invention relates to an LED and reflector assembly for use in signal applications, such as those used with railways.

2. Description of the Prior Art

The railroad industry utilizes wayside signals to indicate authorization for trains to proceed or to stop at certain positions on railroad tracks. Such wayside signals have commonly utilized incandescent lamps to provide indications, such as to proceed or stop, to trains.

The use of incandescent lamps in wayside signals results in certain drawbacks. First, the life of incandescent lamps is relatively short, i.e., an incandescent lamp typically burns out in a relatively short period of time of approximately 6 to 12 months. This may be particularly problematic in wayside signals for railways as such signals may often be placed at remote locations along railway tracks. As a result, it is often inconvenient and time consuming for maintenance personnel to replace a burned out wayside signal. Additionally, any time a wayside signal burns out, safety concerns are raised and the use of certain railroad track sections may be prohibited, resulting in a loss of operating efficiency of the railway due to track re-routings. A further drawback with the use of incandescent lamps in wayside signals is that incandescent lamps are relatively energy inefficient.

Accordingly, a need exists for an improved means for providing wayside signals for use with railways.

SUMMARY OF THE INVENTION

These needs and others are met by embodiments of the invention, which are directed to an improved light assembly. The light assembly comprises a lighting module having a number of LEDs, a reflector assembly disposed on the lighting module, a lens member disposed over the reflector assembly and coupled to the lighting module, and a membrane disposed between the reflector member and the lens. The reflector assembly includes a number of individual reflector portions, each reflector portion being of generally concave shape and structured to selectively direct light emitted from a respective one of the number of LEDs.

The membrane may comprise a nylon screen material. The membrane may comprise a phankill screen. The lighting module may comprise a plurality of LEDs and the reflector assembly may comprise a plurality of reflector portions, each reflector portion being disposed about a corresponding one of the plurality of LEDs. The plurality of reflector portions may comprise a first number of reflector portions, each reflector portion of the first number of reflector portions being structured to generally direct light emitted from a corresponding LED a first distance from the light assembly. The plurality of reflector portions may comprises a second number of reflector portions, each reflector portion of the second number of reflector portions being structured to generally direct light emitted from a corresponding LED a second distance from the light assembly, wherein the first distance is greater than the second distance. The first number of reflector portions may be disposed in a first pattern and the second number of reflector portions may are disposed in a second pattern generally around the first pattern. The plurality of reflectors may comprise a first number of reflector portions disposed in a first pattern and a second number of reflector portions disposed in a second pattern generally around the first pattern. Each reflector portion of the first number of reflector portions may be structured to direct light emitted from a corresponding LED a first distance from the light assembly and each reflector portion of the second number of reflector portions may be structured to direct light emitted from a corresponding LED a second distance greater than the first distance. The number of individual reflector portions may be structured to selectively direct light in an AREMA specified pattern. The first number of reflector portions may comprise four reflector portions and the second number of reflector portions may comprise ten reflector portions.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

Figure 1:
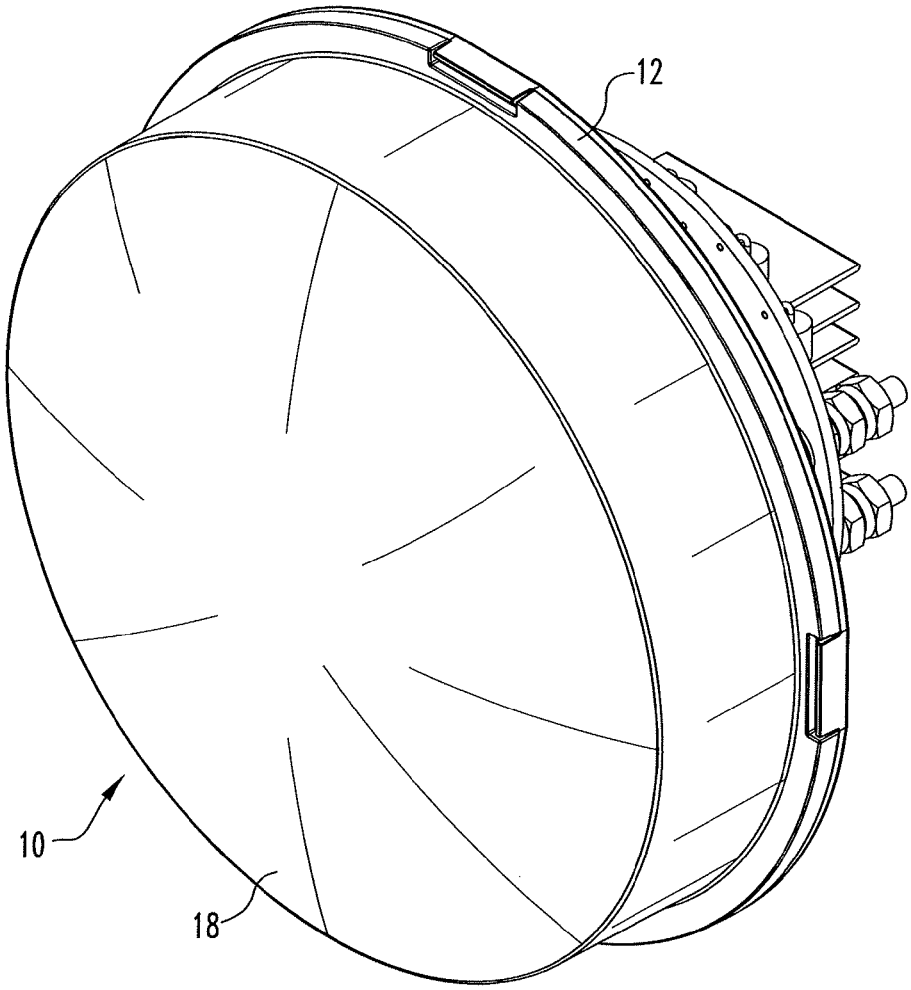
FIG. 1 is an isometric view of a light assembly in accordance with an embodiment of the invention.

FIG. 1 shows a light assembly 10 in accordance with an embodiment of the invention. Light assembly 10 may be commonly mounted on a pole or other structure (not shown) generally at or about a section of railway such as to be readily viewed by a train approaching on the adjacent railway.

Figure 2:
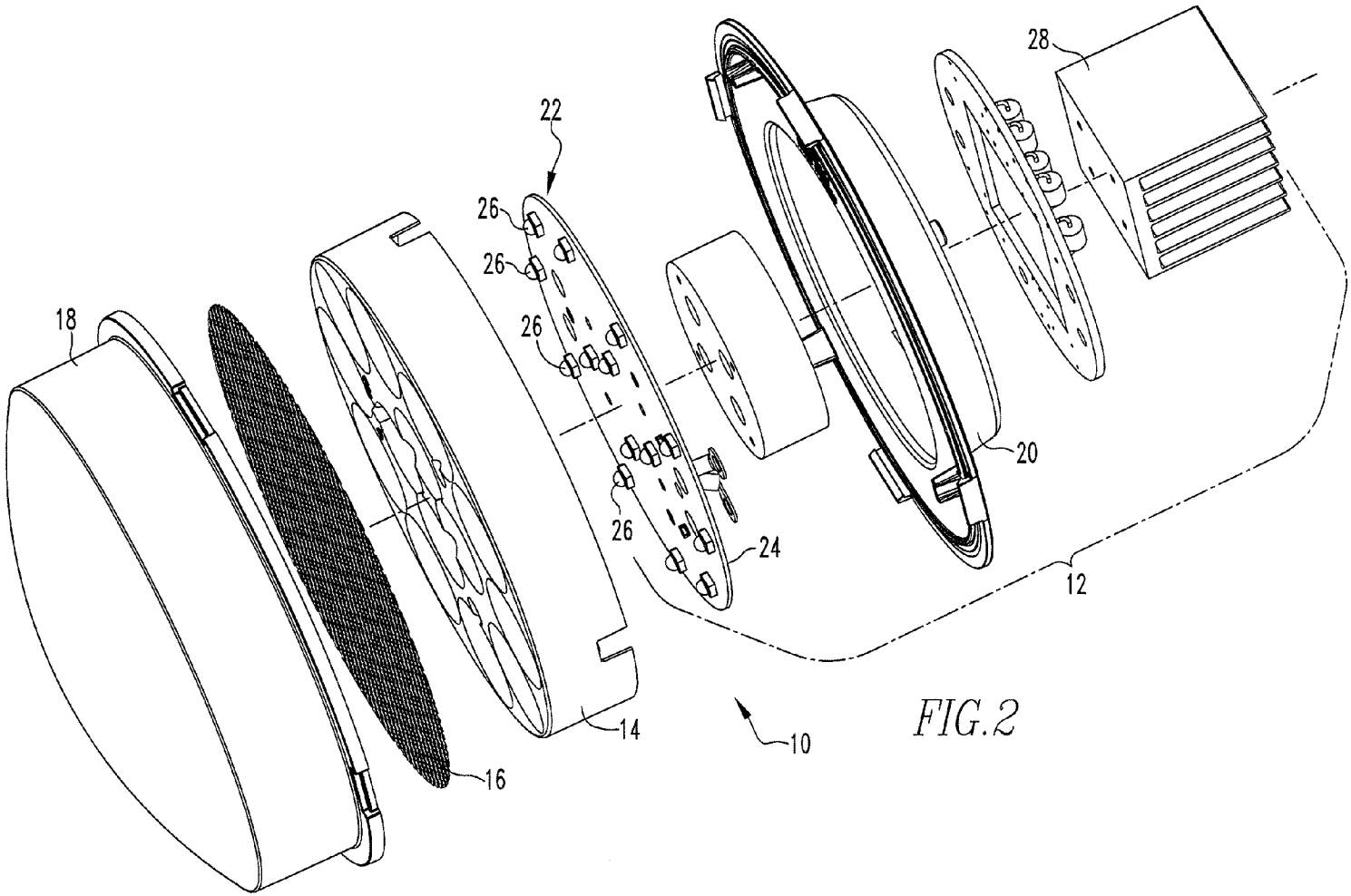
FIG. 2 is an exploded view of the light assembly of FIG. 1.
Figure 3:
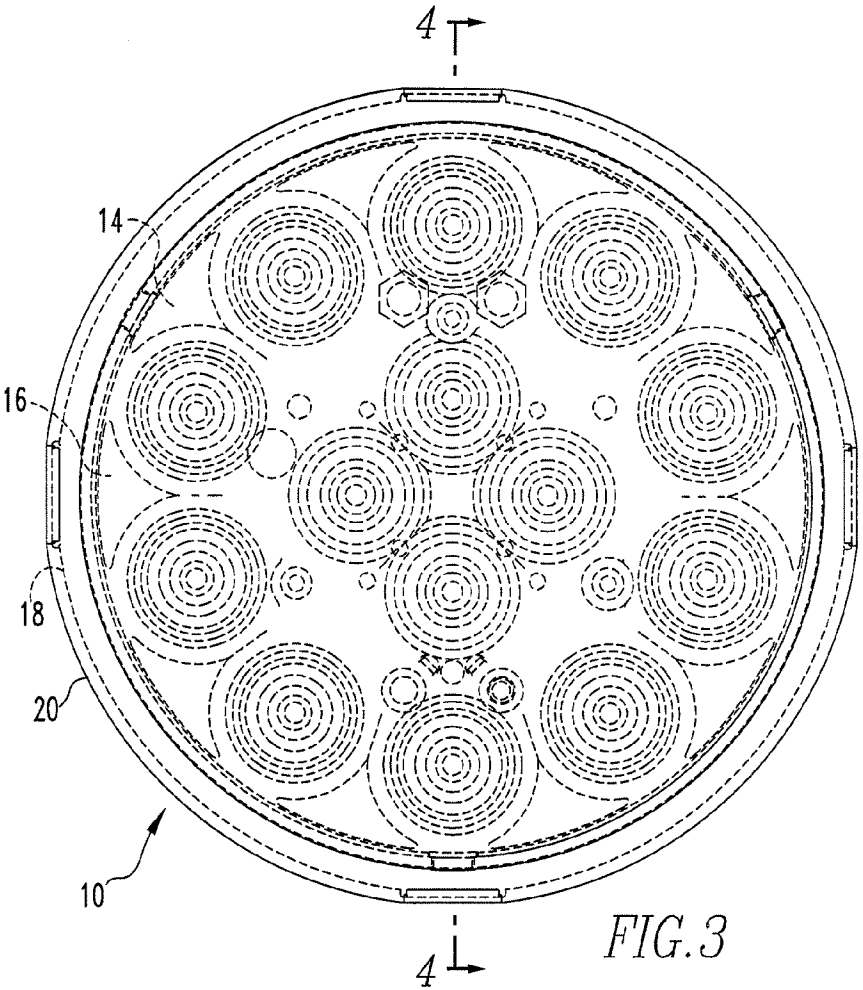
FIG. 3 is a front elevation view of the light assembly of FIG. 1.
Figure 4:
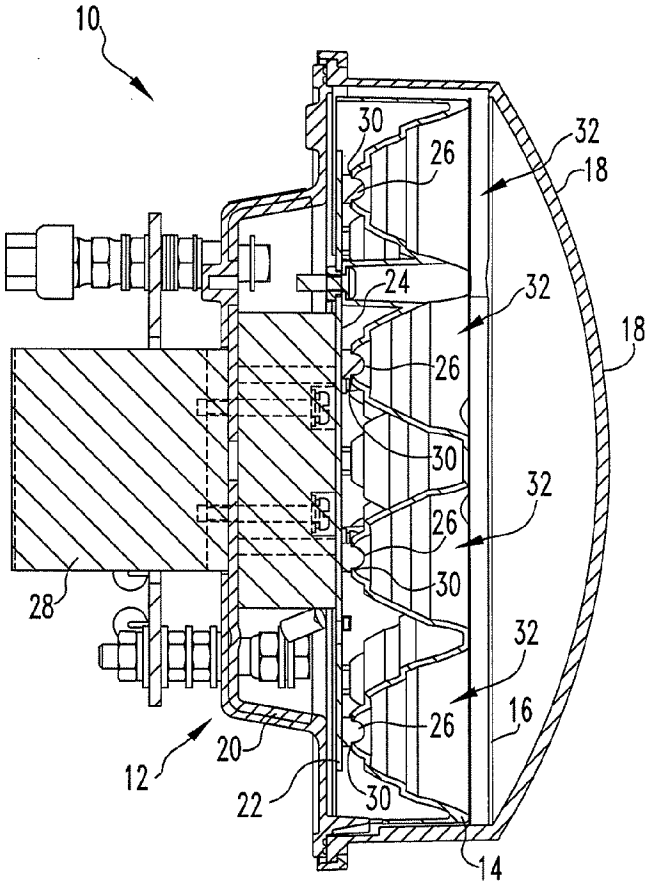
FIG. 4 is a cross-sectional view of the light assembly taken along line 4-4 of FIG. 3.

As shown in the exploded view of FIG. 2 and the cross-sectional view of FIG. 4, light assembly 10 includes a base portion 12 a reflector assembly 14 coupled thereto, a screen member 16 disposed generally over the reflector portion, and a lens member 18 disposed over the screen member 16 and reflector portion 14 and coupled to the base portion 12.

Continuing to refer to FIG. 2, base portion 12 generally includes a housing portion 20 with a light emitting member 22 disposed therein. In the depicted embodiment, light emitting member 22 comprises a printed circuit board 24 having a number of light emitting diodes 26 (LED's) disposed thereon. As employed herein, the term "number" shall mean one or an integer greater than one (i.e., a plurality). One or more heatsinks 28 may be coupled to or near printed circuit board 24 in order to help direct away and dissipate heat from the LED's 26.

Figure 5:
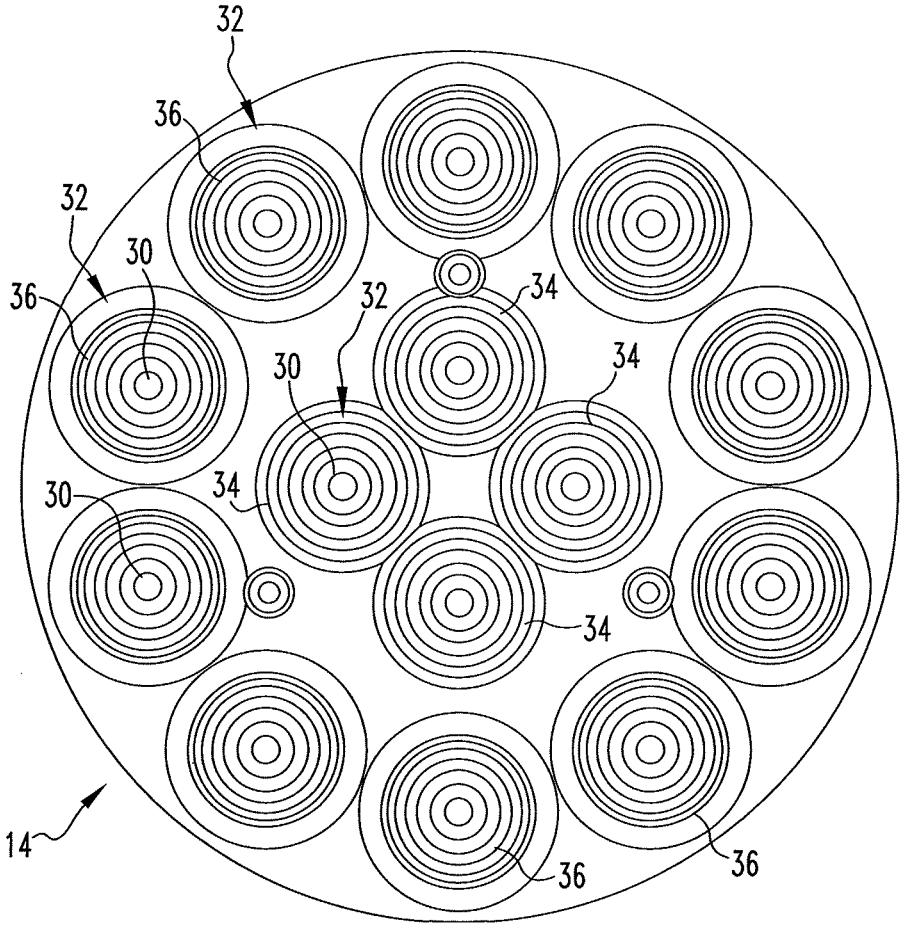
FIG. 5 is a front elevation view of the reflector of FIGS. 1-4.

Reflector assembly 14 is preferably formed from a plastic having a reflective coating or other suitable material that may readily have one or more individual reflectors formed therein. Although shown as a single unitary member, it is to be appreciated that reflector assembly 14 may be formed from a number of separate elements assembled together or in multiple elements without varying from the scope of the present invention. Referring to FIGS. 4 and 5, reflector assembly 14 includes a number of apertures 30 which are each sized to accept an LED 26 therein when reflector assembly 14 is coupled to base portion 12 over printed circuit board 24, as perhaps best shown in the cross sectional view of FIG. 4. Reflector assembly 14 further includes a number of generally concave shaped individual reflector portions 32 generally disposed around each of the apertures 30. Each of reflector portions 32 is of suitable shape to reflect/project light produced by an LED 26 (disposed in the associated aperture 30) a distance outward from the light assembly 10. In a particular light assembly, all of the individual reflector portions 32 may be of similar design and thus reflect light in a similar manner, alternatively, the reflector portions 32 may be of multiple designs and thus may reflect light produced by the associated LED's in different manners.

For example, in the embodiment depicted in the Figs., two different reflector designs are utilized. A first number of reflectors 34 of a first design are arranged in a generally circular arrangement (pattern) near a central portion of reflector assembly 14. A second number of reflectors 36 of a second design are arranged in another arrangement generally around the first number of reflectors 34. In such embodiment, each reflector 34 of the first number of reflectors is designed to project light a greater from the light assembly 10 than each reflector 36 of the second number of reflectors. Such general arrangement provides for an overall light emission that is visible from far distances but yet full from closer distances. By selectively arranging reflectors of different designs the light signal projected by the light assembly 10 can be tailored to produce specific desired outputs. For example, the example light assembly depicted in the Figs. is arranged to produce a light signal projected according to an AREMA (American Railway Engineering and Maintenance-of-Way Association) specification which may be arranged as a matrix of angles in the x and y directions with specific candlepower in each location.

As shown in the cross-sectional view of light assembly 10 in FIG. 4, screen 16 is generally disposed across all or substantially all of reflector assembly 14. Screen member 16 is preferably formed from a flat black nylon screen or other suitable material. When light assembly 10 is in use, screen member 16 generally functions as an antiphantom (i.e., phankill) mechanism that acts to reduce the appearance of false illumination of light assembly 10 due to light from sources of light external to light assembly 10 (e.g., without limitation sunlight) striking reflector assembly 14. In order to further prevent false illumination signals, flat surfaces of the reflector assembly 14, such as those between reflectors 32, are preferably colored black or another suitable dark, non reflective color.

Continuing to refer to the cross-sectional view of FIG. 4, lens member 18 is preferably formed from a clear plastic or other suitable material (e.g., without limitation, polished aluminized plastic) and is of a generally concave shape formed to generally enclose reflector assembly 14 therein when lens member 18 is coupled to base portion 12. Preferably such coupling is of a type that allows for lens member 18 to be selectively uncoupled from base portion 12 in order to allow for maintenance of the light assembly 10. Furthermore, such coupling preferably provides for the contents of light assembly 10 to be generally sealed in order to prevent the ingress of water or other unwanted environmental elements.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A light assembly comprising:

a lighting module having a number of light emitting diodes;

a reflector assembly disposed on the lighting module, the reflector assembly having a number of individual reflector portions, each reflector portion being of generally concave shape and structured to selectively direct light emitted from a respective one of the number of light emitting diodes;

a lens member disposed over the reflector assembly and coupled to the lighting module; and a non-reflective membrane disposed between the reflector member and the lens.

2. The light assembly of claim 1 wherein the membrane comprises a nylon screen material.

3. The light assembly of claim 1 wherein the membrane comprises a phankill screen.

4. The light assembly of claim 1 wherein the plurality of reflector portions comprise:

a first number of reflector portions, each reflector portion of the first number of reflector portions being structured to generally direct light emitted from a corresponding light emitting diode a first distance from the light assembly; and a second number of reflector portions, each reflector portion of the second number of reflector portions being structured to generally direct light emitted from a corresponding light emitting diode a second distance from the light assembly, wherein the first distance is greater than the second distance.

5. The light assembly of claim 4 wherein the first number of reflector portions are disposed in a first pattern and wherein the second number of reflector portions are disposed in a second pattern generally around the first pattern.

6. The light assembly of claim 4 wherein the plurality of reflectors comprise:

a first number of reflector portions disposed in a first pattern; and a second number of reflector portions disposed in a second pattern generally around the first pattern.

7. The light assembly of claim 6 wherein each reflector portion of the first number of reflector portions is structured to direct light emitted from a corresponding light emitting diode a first distance from the light assembly and each reflector portion of the second number of reflector portions is structured to direct light emitted from a corresponding light emitting diode a second distance greater than the first distance.

8. The light assembly of claim 1 wherein the number of individual reflector portions are structured to selectively direct light in an American Railway Engineering and Maintenance-of-Way Association specified pattern.

9. The light assembly of claim 1 wherein the first number of reflector portions comprises four reflector portions and the second number of reflector portions comprises ten reflector portions.

10. A light assembly comprising:

a light emitting member having at least one source of light;

a reflector assembly disposed on the light emitting member, the reflector assembly having a number of individual reflector portions, each reflector portion being of generally concave shape and structured to selectively direct light emitted from the at least one source of light;

a lens member disposed over the reflector assembly; and a non-reflective membrane disposed between the reflector member and the lens.

11. The light assembly of claim 10 wherein the at least one source of light comprises a light emitting diode.

12. The light assembly of claim 10 wherein the membrane comprises a nylon screen material.

13. The light assembly of claim 10 wherein the membrane comprises a phankill screen.

14. The light assembly of claim 10 wherein the at least one source of light comprises a plurality of light emitting diodes and the reflector assembly comprises a plurality of reflector portions, each reflector portion being disposed about a corresponding one of the plurality of light emitting diodes.

15. The light assembly of claim 10 wherein the number of individual reflector portions are structured to selectively direct light in an American Railway Engineering and Maintenance-of-Way Association specified pattern.

16. The light assembly of claim 14 wherein the first number of reflector portions comprises four reflector portions and the second number of reflector portions comprises ten reflector portions.

17. The light assembly of claim 1 wherein the membrane comprises a flat black screen.

* * * * *